US012679627B2

(12) United States Patent
Mann et al.

(10) Patent No.: US 12,679,627 B2
(45) Date of Patent: Jul. 14, 2026

(54) CONTAINER

(71) Applicant: BERRY GLOBAL, INC., Evansville, IN (US)

(72) Inventors: Jeffrey A. Mann, Evansville, IN (US); Roy E. Ackerman, Evansville, IN (US); Jonathan Eickhoff, Evansville, IN (US); Christopher M. Bolek, Evansville, IN (US); Adam M. Schneider, Evansville, IN (US)

(73) Assignee: BERRY GLOBAL, INC., Evansville, IN (US)

( * ) Notice: Subject to any disclaimer, the term of this patent is extended or adjusted under 35 U.S.C. 154(b) by 0 days.

(21) Appl. No.: 18/800,605

(22) Filed: Aug. 12, 2024

(65) Prior Publication Data

US 2025/0051081 A1 Feb. 13, 2025

Related U.S. Application Data

(60) Provisional application No. 63/532,094, filed on Aug. 11, 2023.

(51) Int. Cl.
*B65D 81/38* (2006.01)
*B65D 25/20* (2006.01)

(52) U.S. Cl.
CPC ..... *B65D 81/3818* (2013.01); *B65D 25/20* (2013.01)

(58) Field of Classification Search
CPC ..... B65D 81/3869; B65D 81/3865; B65D 81/3874; B65D 81/3876; B65D 81/3818; B65D 25/20
See application file for complete search history.

(56) References Cited

U.S. PATENT DOCUMENTS 3,443,715 A * 5/1969 Edwards ..... B65D 1/265 206/499
5,713,512 A * 2/1998 Barrett ..... B65D 81/3869 220/592.2
5,769,311 A * 6/1998 Morita ..... B31F 1/007 220/62.12
8,701,914 B1 * 4/2014 Buck ..... B65D 81/3869 229/403
2011/0215103 A1 * 9/2011 Lee ..... B65D 81/3837 220/592.2
2015/0298889 A1 * 10/2015 Leser ..... B32B 7/02 220/739
2017/0340149 A1 * 11/2017 Morgan ..... B65D 81/3869
2018/0016052 A1 * 1/2018 Tomioka ..... B65D 3/22
2019/0047265 A1 * 2/2019 Euler ..... B65D 1/265
2022/0063250 A1 * 3/2022 Gupta ..... B32B 1/00
2022/0234812 A1 * 7/2022 Mohan ..... B31B 50/62

FOREIGN PATENT DOCUMENTS

GB 2501397 A * 10/2013 ..... B65D 81/38

* cited by examiner

*Primary Examiner* — Don M Anderson
(74) *Attorney, Agent, or Firm* — Barnes & Thornburg LLP

(57) ABSTRACT

An insulative container includes a container body and a container sleeve. The container body includes a floor, a brim spaced apart from the floor, and a side wall extending between and interconnecting the floor and the brim and extending circumferentially around a central axis of the container body. The container sleeve is coupled to the container body.

8 Claims, 6 Drawing Sheets

CONTAINER

PRIORITY CLAIM

This application claims priority under 35 U.S.C. § 119 (e) to U.S. Provisional Patent Application No. 63/532,094, filed Aug. 11, 2023, which is expressly incorporated by reference herein in its entirety.

BACKGROUND

The present disclosure relates to a container, and particularly to a container including one or more polymeric materials. More particularly, the present disclosure relates to an insulative container including one or more polymeric materials.

SUMMARY

According to the present disclosure, an insulative container includes a container body. The container body includes a floor, a brim spaced apart from the floor, and a side wall extending between and interconnecting the floor and the brim and extending circumferentially around a central axis of the container body.

In illustrative embodiments, the side wall is formed to include a plurality of projections spaced apart from one another around a periphery of the side wall. The container further includes a container sleeve extending annularly around the side wall and coupled to each of the projections included in the plurality of projections along an outer surface of the side wall. The container sleeve is attached to a tip of each projection and is spaced apart from an inner end of each projection to provide an air gap between the container sleeve and the inner end of each projection.

In illustrative embodiments, the container body includes an insulative cellular non-aromatic material having a polypropylene base resin and the container sleeve includes a heat-shrinkable polymeric material. The heat-shrinkable polymeric material may include polyethylene terephthalate or polypropylene.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

Figure 8:
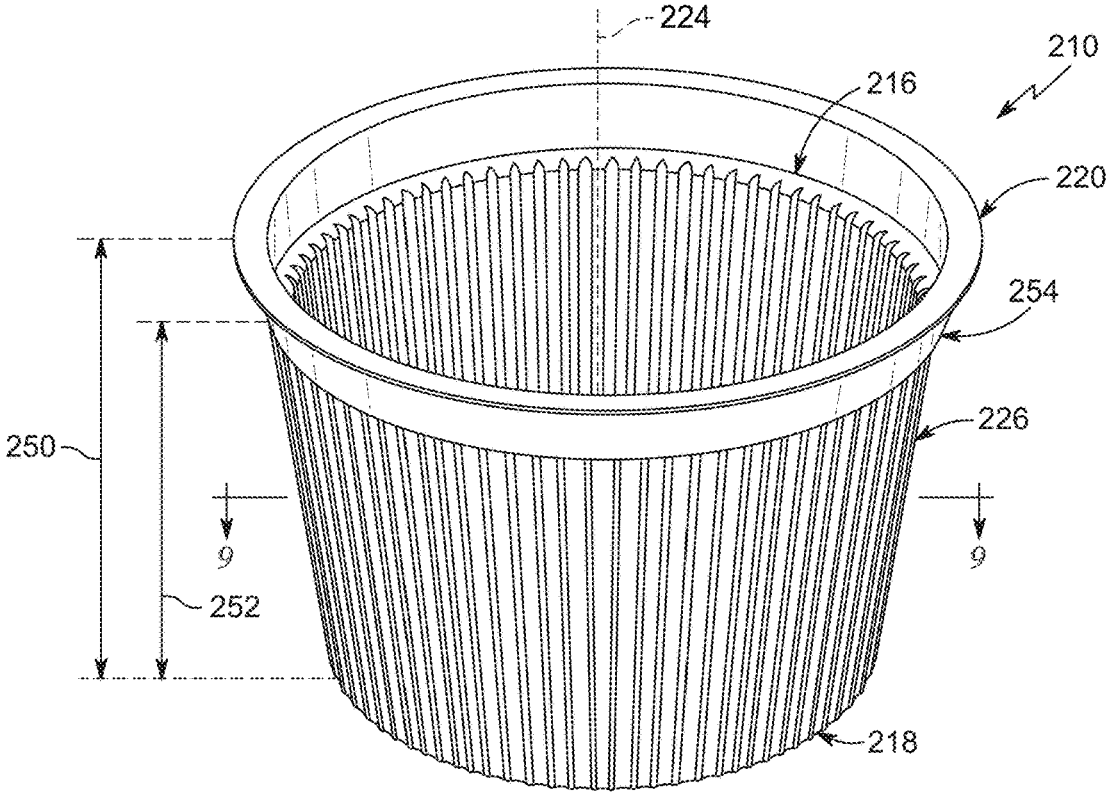
FIG. 8 is a perspective view of the container with the container sleeve removed to show that the side wall is formed to include a plurality of outwardly-extending projections and a plurality of inwardly-extending projections in a region of the side wall where the container sleeve is attached.
Figure 9:
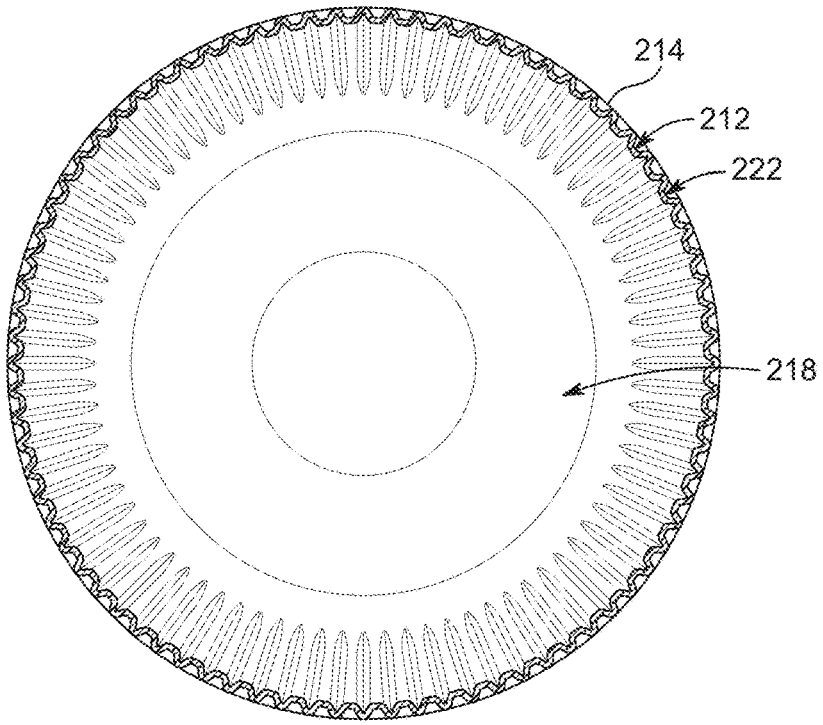
Figure 10:
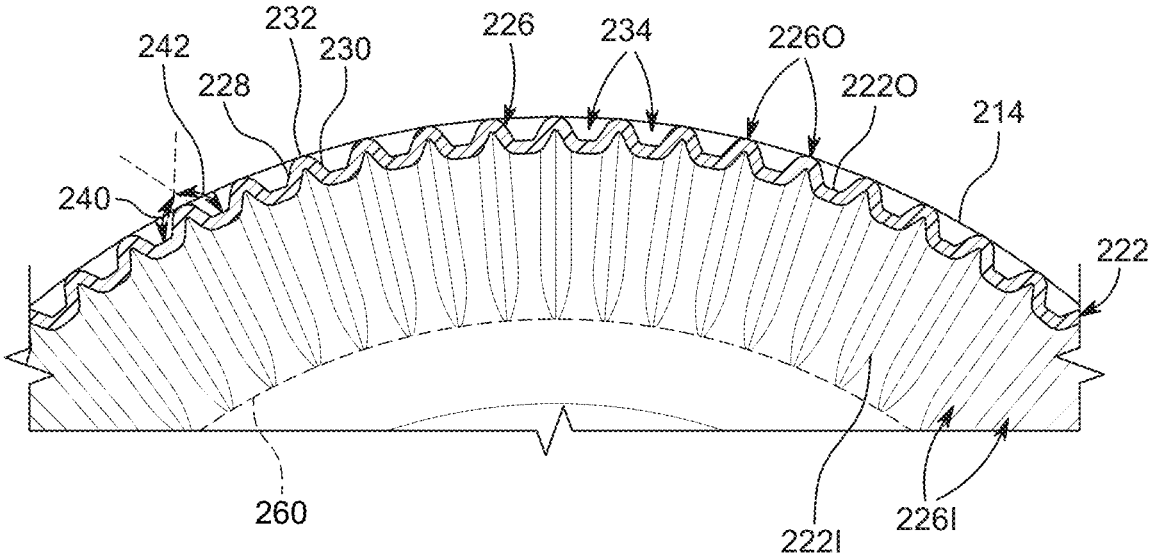

FIG. 9 is a cross section taken along line 9-9 in FIG. 8 showing that the container sleeve is attached to a distal tip of each projection included in the plurality of outwardly-extending projections and is spaced apart from an inner end of each outwardly-extending projection to provide an air gap between the container sleeve and the inner end of each outwardly-extending projection; and FIG. 10 is an enlarged view of a portion of FIG. 9 showing that each projection includes a curved tip providing an attachment point for the container sleeve, a first circumferential side segment coupled to the curved tip, and a second circumferential side segment coupled to an opposite end of the curved tip.

DETAILED DESCRIPTION

An insulative container 10 is configured to hold food during heating and consumption of the food by a user. The insulative container 10 minimizes heat from being transmitted through the container to the user's hands. A first embodiment of an insulative container formed by injection molding is shown in FIGS. 1-5. A second embodiment of an insulative container 210 formed by thermoforming is shown in FIGS. 6-10.

Figure 1:
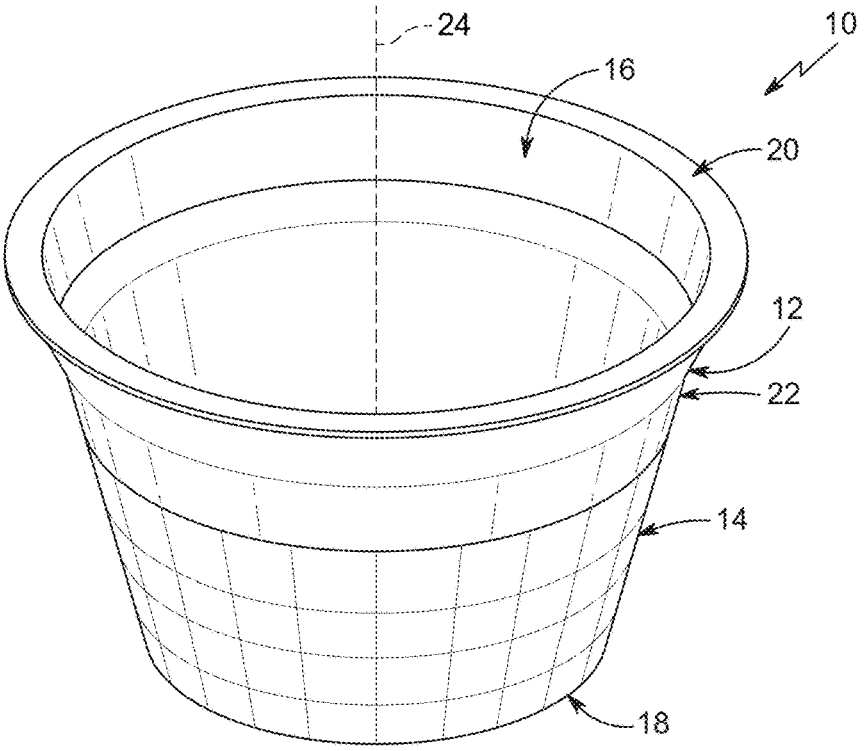
FIG. 1 is a perspective view of an insulative container including a container body having a floor, a brim, and a sidewall extending between the floor and the brim and a container sleeve coupled to an outer surface of the side wall of the container body.
Figure 2:
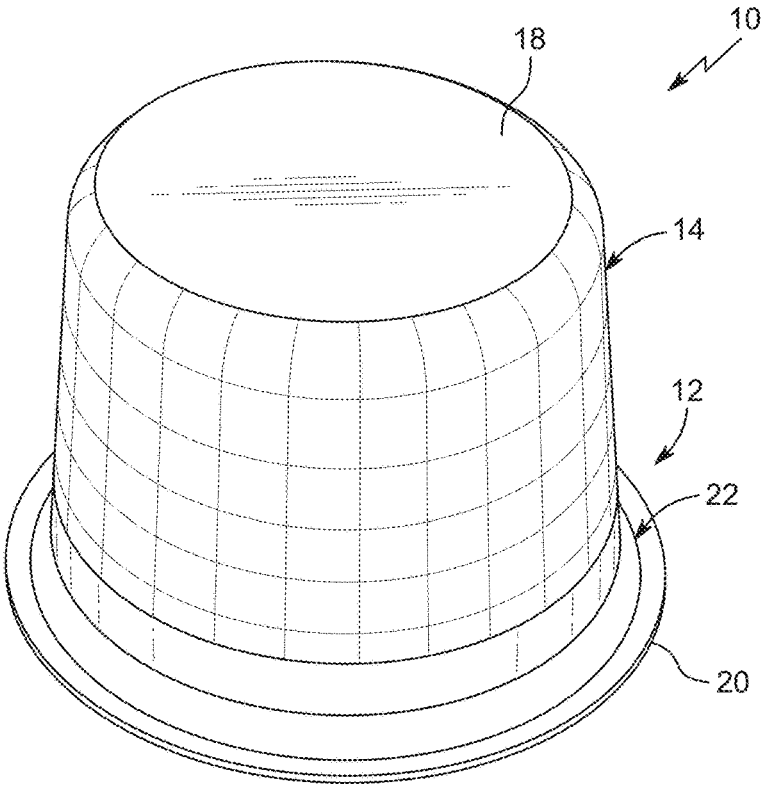
FIG. 2 is another perspective view of the insulative container showing that the insulative sleeve extends only partway along a height of the sidewall from the floor to a shoulder included in the side wall.

The insulative container includes a container body 12 and a container sleeve 14 coupled to the container body 12 as shown in FIGS. 1 and 2. The container body 12 defines an interior space 16 configured to hold the food during heating and consumption of the food. The container body 12 has a floor 18, a brim 20 spaced apart from the floor 18, and a side wall 22 extending between and interconnecting the floor 18 and the brim 20 and extending circumferentially around a central axis 24 of the container 10. The side wall 22 includes an annular side-wall sleeve 25 and a plurality of projections 26 spaced apart from one another around a periphery of the annular side-wall sleeve 25. The annular side-wall sleeve 25 has an outer surface 250 facing away from the central axis 24 and an inner surface 251 facing toward the central axis 24. Each of the projections 26 is coupled to the outer surface 250 of the annular side-wall sleeve 25 and formed integrally with the annular side wall sleeve 25.

The container sleeve 14 extends annularly around the side wall 22 and is coupled to each of the projections 26 along an outer surface of the side wall 22. The container sleeve 14 is spaced apart from the outer surface 250 of the annular side wall sleeve 25 to provide a plurality of insulative air gaps 34 between the container sleeve 14 and the annular side wall sleeve 25 to increase insulative properties of the container 10. The plurality of projections 26 maintain spacing between the container sleeve 14 and the annular side wall sleeve 25. The plurality of projections 26 also minimizes a hot surface area that comes into contact with the hand or fingers of an end user as the end user will normally only engage the outermost tips of each projection 26. In this way, heat transfer to the end user's fingers is minimized.

Figure 4:
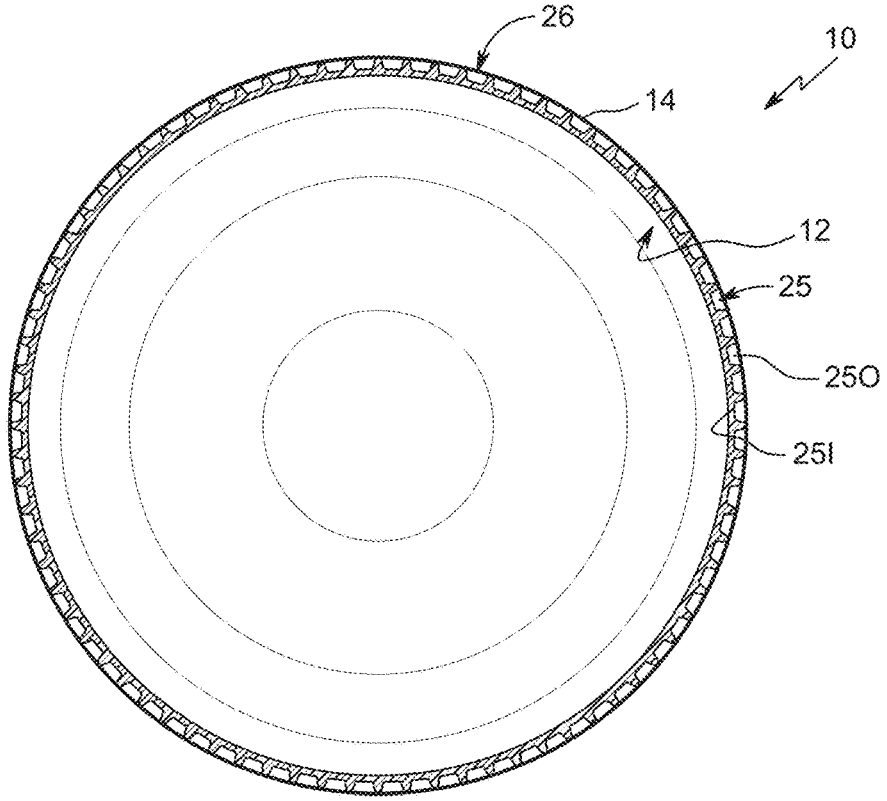
FIG. 4 is a cross section taken along line 4-4 in FIG. 3 showing that the container sleeve is attached to a distal tip of each projection included in the plurality of projections and is spaced apart from an inner end of each projection to provide an air gap between the container sleeve and the inner end of each projection.
Figure 5:
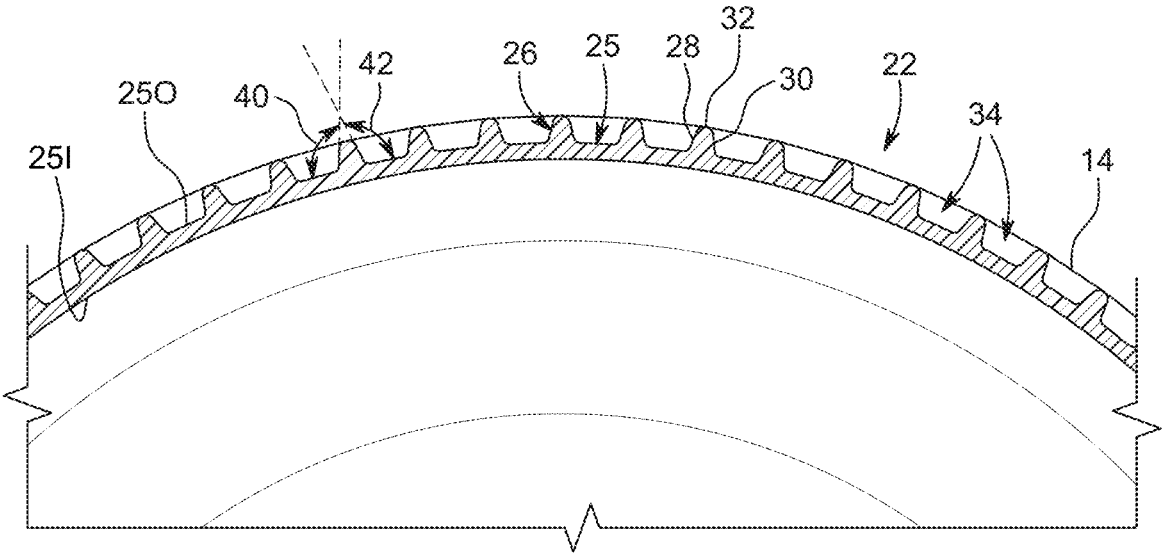
FIG. 5 is an enlarged view of a portion of FIG. 4 showing that each projection includes a curved tip providing an attachment point for the container sleeve, a first circumferential side segment coupled to the curved tip, and a second circumferential side segment coupled to an opposite end of the curved tip.

Each of the projections 26 includes a vertically extending rib in the illustrative embodiment. Each vertically extending rib has a first circumferential side segment 28, a second circumferential side segment 30, and a curved tip 32 as shown in FIGS. 4 and 5. The first circumferential side segment 28 is arranged at a first angle 40 relative to the outer surface 250 of the annular side wall sleeve 25. The second circumferential side segment 30 is arranged at a second angle 42 relative to the outer surface 250 of the annular side wall sleeve 25. The curved tip 32 interconnects an outer end of the first and second circumferential side segments 28, 30. The first and second angles 40, 42 complement one another so that the first and second circumferential side segments 28, 30 converge toward one another until they reach the curved tip 32. The angles 40, 42 and the curved tip 32 help release of the container body 12 from one or more molds used to form the container body 12 and provide a smooth attachment point for the container sleeve 14.

In the illustrative embodiment, the container sleeve 14 is made from a suitable heat-shrinkable material, such as polyethylene terephthalate or polypropylene, and is subjected to heat during manufacturing of the container 10 to cause the container sleeve 14 to constrict around the plurality of projections 26. The container sleeve 14 is attached to the curved tip 32 of each vertically extending rib 26 and is spaced apart from an inner end of each first and second circumferential side segment 28, 30. This arrangement provides the air gap 34 between the container sleeve 14 and the inner end of each first and second circumferential side segments 28, 30. In some embodiments, constricting the container sleeve 14 around each of the projections 26 results in the container sleeve 14 extending in a straight line between each curved tip 32 such that the container sleeve 14 has a plurality of planar segments around the central axis 24.

Each vertically extending rib 26 extends only partway along a height 50 of the side wall 22 of the container body 12. Specifically, each vertically extending rib 26 has a height 52 that is less than the height 50 of the side wall 22 of the container body 12. Each of the vertically extending ribs extends from the floor 18 to shoulder 54 formed into the side wall 22. The shoulder 54 is spaced below the brim 20.

Figure 3:
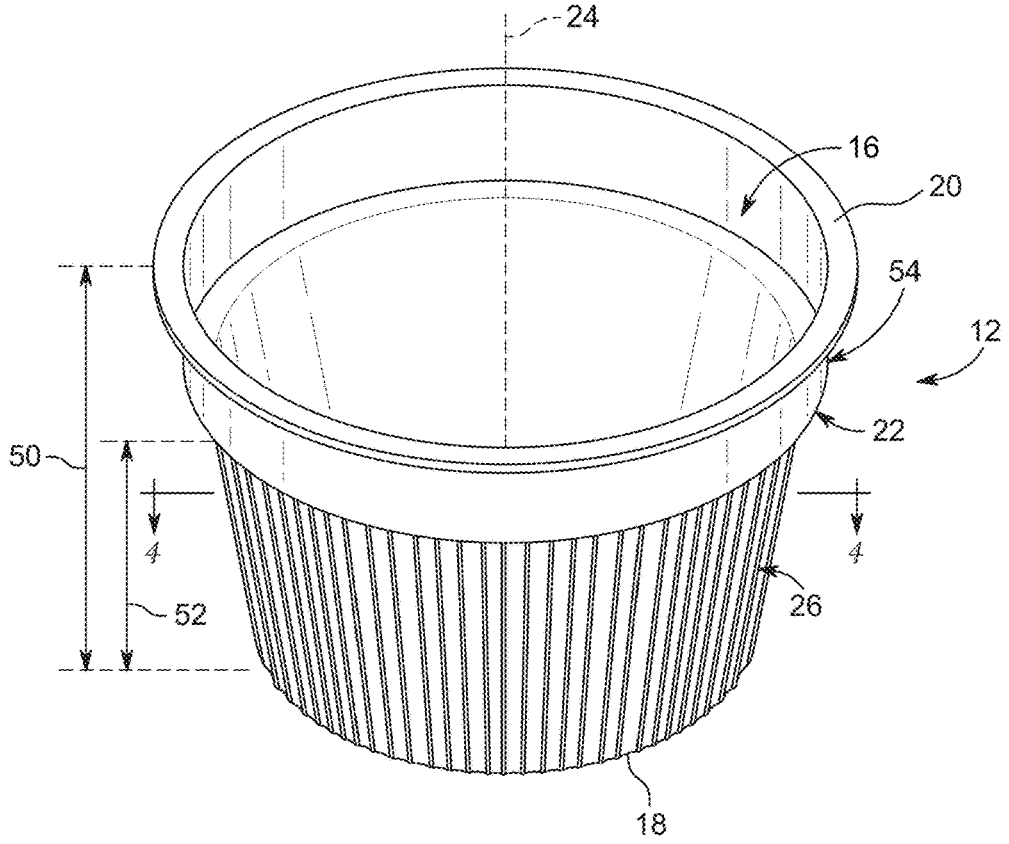
FIG. 3 is a perspective view of the container with the container sleeve removed to show that the side wall is formed to include a plurality of projections in a region of the side wall where the container sleeve is attached.

In illustrative embodiments, the container body 12 is injection molded from an insulative, non-aromatic material having a polypropylene base resin. Thus, the container body 12 may be formed from a formulation comprising all or mostly all polypropylene. The inner surface 251 of the annular side-wall sleeve 25 is formed without any of the projections 26 so that each axial height of the container body 12 along the central axis 24 has a substantially constant radius from the central axis 24. The vertical orientation of the ribs 26 help release the container body 12 from one or more molds used to injection mold the container body 12. The container body 12 shown in FIGS. 3-5 is drawn to scale such that the features shown are proportional to one another.

Figure 6:
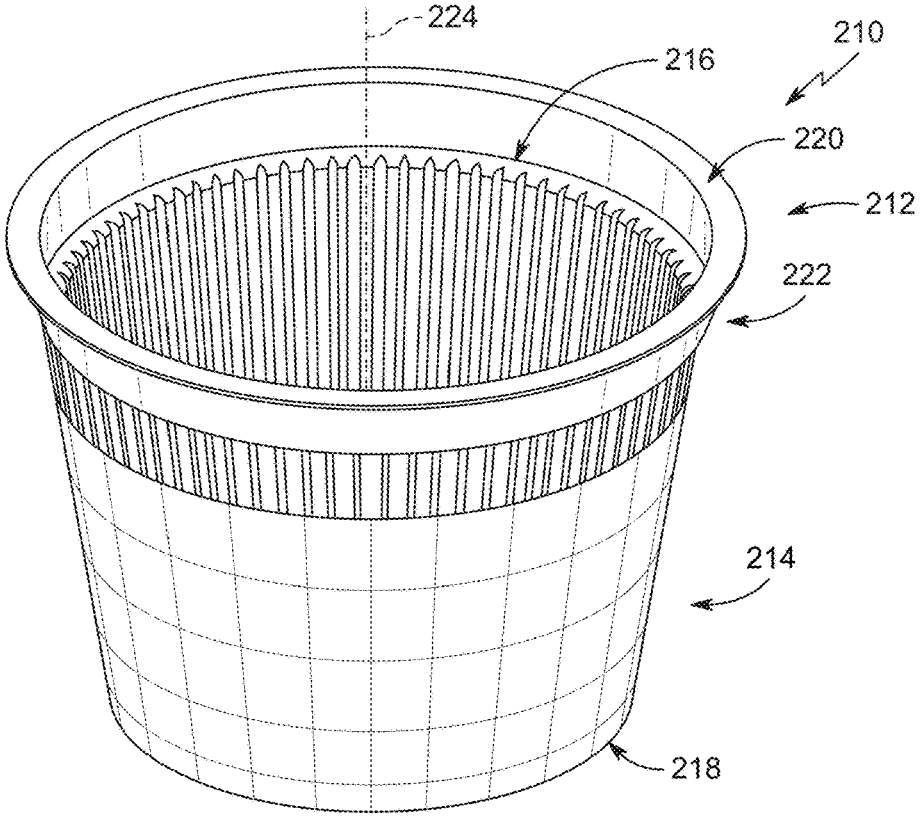
FIG. 6 is a perspective view of another embodiment of an insulative container including a container body having a floor, a brim, and a sidewall extending between the floor and the brim and a container sleeve coupled to an outer surface of the side wall of the container body.
Figure 7:
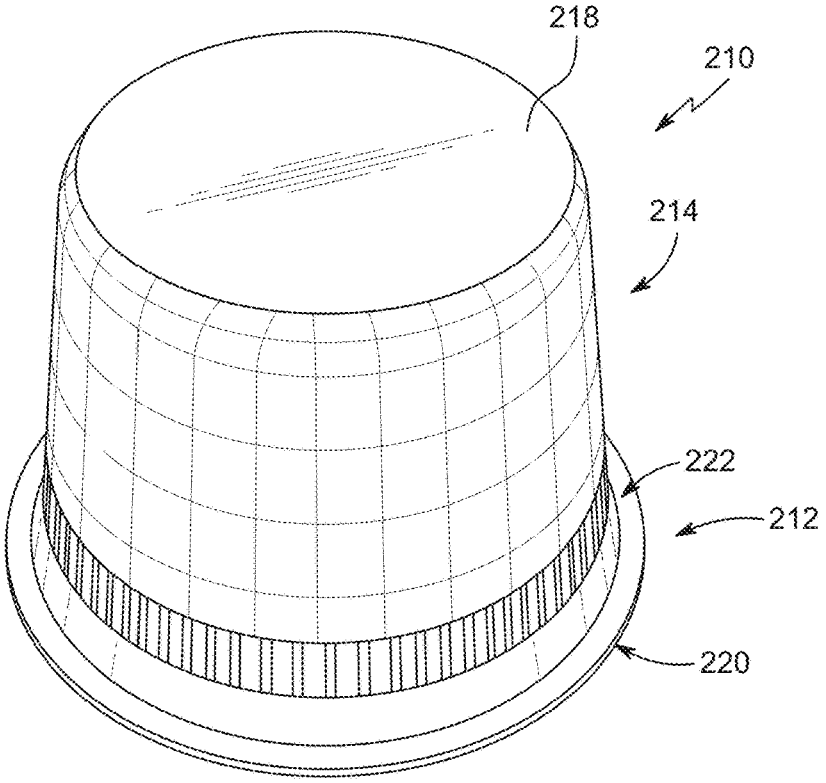
FIG. 7 is another perspective view of the insulative container of FIG. 6 showing that the insulative sleeve extends only partway along a height of the sidewall from the floor to a shoulder included in the side wall.

Another insulative container 210 configured to hold food during heating and consumption of the food by a user is shown in FIGS. 6-10. The insulative container 210 includes a container body 212 and a container sleeve 214 coupled to the container body 212 as shown in FIGS. 6 and 7. The container body 212 defines an interior space 216 configured to hold the food during heating and consumption of the food. The container body 212 has a floor 218, a brim 220 spaced apart from the floor 218, and a side wall 222 extending between and interconnecting the floor 218 and the brim 220 and extending circumferentially around a central axis 224 of the container 210. The side wall 222 is formed to include a plurality of projections 226 spaced apart from one another around a periphery of side wall 222.

The container sleeve 214 extends annularly around the side wall 222 and is coupled to each of the projections 226 along an outer surface of the side wall 222. The container sleeve 214 is spaced apart from portions of the side wall 222 to provide a plurality of insulative air gaps 234 to increase insulative properties of the container 210. The plurality of projections 226 maintain spacing between the container sleeve 214 and the portions of the side wall 222. The plurality of projections 226 also minimizes a hot surface area that comes into contact with the hand or fingers of an end user since the end user will normally only engage the outermost tips of each projection 226. In this way, heat transfer to the end user's fingers is minimized.

Each of the projections 226 includes a vertically extending rib in the illustrative embodiment. Each vertically extending rib has a first circumferential side segment 228, a second circumferential side segment 230, and a curved tip 232 as shown in FIGS. 9 and 10. The first circumferential side segment 228 is arranged at a first angle 240. The second circumferential side segment 230 is arranged at a second angle 42. The curved tip 232 interconnects an outer end of the first and second circumferential side segments 228, 230. The first and second angles 240, 242 complement one another so that the first and second circumferential side segments 228, 230 converge toward one another until they reach the curved tip 232. The angles 240, 242 and the curved tip help release of the container body 212 from one or more molds used to thermoform the container body 212 and provide a smooth attachment point for the container sleeve 214.

In the illustrative embodiment, the container sleeve 214 is made from a heat-shrinkable material, such as polyethylene terephthalate or polypropylene, and is subjected to heat during manufacturing of the container 210 to cause the container sleeve 214 to constrict around the plurality of projections 226. The container sleeve 214 is attached to the curved tip 232 of each vertically extending rib 226 and is spaced apart from an inner end of each first and second circumferential side segment 228, 230. This arrangement provides the air gaps 234 between the container sleeve 214 and the inner end of each first and second circumferential side segments 228, 230. In some embodiments, constricting the container sleeve 214 around each of the projections 226 results in the container sleeve 214 extending in a straight line between each curved tip 232 such that the container sleeve 214 has a plurality of planar segments around the central axis 224.

Each vertically extending rib 226 extends only partway along a height 250 of the side wall 222 of the container body 212. Specifically, each vertically extending rib 226 has a height 252 that is less than the height 250 of the side wall 222 of the container body 212. Each of the vertically extending ribs extends from the floor 218 to shoulder 254 formed into the side wall 222. The shoulder 254 is spaced below the brim 220.

In illustrative embodiments, the container body 212 is thermoformed from an insulative, non-aromatic material having a polypropylene base resin. Thus, the container body 212 may be formed from a formulation comprising all or mostly all polypropylene. The side wall 222 an outer surface 2220 formed to include a plurality of outwardly-projecting ribs 226O and an inner surface 222I formed to include a plurality of inwardly-projecting ribs 226I. The side wall 222 of the container body 212 is serpentine and has a varying radius at each height within the height 252 of the plurality of projections 226. In some embodiments, the container 210 may further include an inner sleeve 260 coupled to inward tips of each inwardly-projecting rib 226I to provide the interior space 216 with a smooth surface and further increase insulative properties of the container 210. The vertical orientation of the ribs 226 help release of one or more molds used to thermoform the container body 212. In the illustrative embodiment, each outwardly-extending rib has the curved tip 232 with a first radius of curvature and each inwardly-extending rib has a tip with a second radius of curvature greater than the first radius of curvature. In some embodiments, at least a portion of the tip of each inwardly-extending rib is planar and/or perpendicular to the central axis 224.

In some embodiments, the container body 12, 212 may be a foamed non-aromatic polymeric material including polypropylene or other suitable polymeric materials, such as VERSALITE® manufactured by Berry Global, Inc., located at 101 Oakley Street, Evansville, IN. For example, a chemical blowing agent may be added to the formulation to reduce a density of the base resin by 5-10%. In some embodiments, a mineral filler, such as talc or calcium, may be added to the formulation. These additives may increase the thermal insulation capabilities of the container 10. The container body 212 shown in FIGS. 8-10 is drawn to scale such that the features shown are proportional to one another.

Reference is hereby made to U.S. application Ser. No. 16/058,131 and U.S. application Ser. No. 16/058,126 for disclosure relating to the polymeric materials that are suitable for the container body 12, 212, which applications are hereby incorporated in their entirety. The material forming the container body 12, 212 is configured to withstand high temperatures and low temperatures and provides sufficient structural rigidity and strength so as not to deform substantially when being grasped by a consumer or puncture when brought into contact with eating utensils, for example. In one embodiment, the entire container 10, 210 is recyclable so that the package can be reclaimed, reground, and reformed into other containers 10, 210. Reference is hereby made to U.S. application Ser. No. 13/875,022 filed on May 1, 2013, U.S. application Ser. No. 14/063,902 filed on Oct. 25, 2013, and U.S. application Ser. No. 14/811,016 filed on Jul. 28, 2015, U.S. application Ser. No. 14/952,103 filed on Nov. 25, 2015 and U.S. application Ser. No. 17/575,098 filed on Jan. 13, 2022, U.S. application Ser. No. 13/847,929 filed on Mar. 20, 2013, U.S. application Ser. No. 14/753,410 filed on Jun. 29, 2016, and U.S. application Ser. No. 15/185,108 filed on Jun. 17, 2016 for disclosure relating to the container body 12, 212, which applications are hereby incorporated herein in their entirety.

The invention claimed is:

1. An insulative container comprising a container body having a floor, a brim spaced apart from the floor, and a side wall extending between and interconnecting the floor and the brim and extending circumferentially around a central axis of the container body, the side wall being formed to include a plurality of vertically extending ribs spaced apart from one another around a periphery of the side wall and a shoulder coupled to an upper end of the plurality of vertically extending ribs and spaced apart from the brim, and a container sleeve extending annularly around the side wall and coupled to each of the vertically extending ribs included in the plurality of vertically extending ribs along an outer surface of the side wall, wherein each vertically extending rib extends only partway along a height of the side wall of the container body from the floor to the shoulder and the sleeve has a lower end coupled to the floor and an upper end that terminates at the shoulder.

2. The insulative container of claim 1, wherein the container body includes an insulative cellular non-aromatic material having a polypropylene base resin and the container sleeve includes a heat-shrinkable polymeric material.

3. The insulative container of claim 2, wherein the heat-shrinkable polymeric material includes polyethylene terephthalate or polypropylene.

4. The insulative container of claim 1, wherein the side wall further includes an annular side-wall sleeve having an outer surface facing away from the central axis and an inner surface facing toward the central axis, and wherein each of the projections is coupled to the outer surface of the annular side-wall sleeve.

5. The insulative container of claim 4, wherein the inner surface of the annular side-wall sleeve is formed without any vertically extending ribs.

6. The insulative container of claim 5, wherein the container body is injection molded and includes a first thickness at each of the projections and a second thickness between each of the projections, the first thickness being greater than the second thickness.

7. The insulative container of claim 1, wherein the shoulder divides the sidewall into a lower portion having the plurality of vertically extending ribs and an upper portion spaced apart from the lower portion, and wherein an outer surface of the sleeve and an outer surface of the upper portion of the side wall are flush with one another in a radial direction relative to the central axis.

8. The insulative container of claim 1, wherein the sleeve extends around a lower end of the side wall and onto a lower surface of the floor.

* * * * *